United States Patent [19]

Rudnick

[11] Patent Number: 4,642,175

[45] Date of Patent: Feb. 10, 1987

[54] PROCESS FOR UPGRADING HEAVY PETROLEUM FEEDSTOCK

[75] Inventor: Leslie R. Rudnick, Lawrenceville, N.J.

[73] Assignee: Mobil Oil Corporation, New York, N.Y.

[21] Appl. No.: 713,376

[22] Filed: Mar. 19, 1985

Related U.S. Application Data

[63] Continuation-in-part of Ser. No. 606,498, May 3, 1984, abandoned.

[51] Int. Cl.[4] ..... C10G 55/04

[52] U.S. Cl. ..... 208/88; 208/48 AA; 208/106; 208/131; 208/240

[58] Field of Search ..... 208/88, 85, 237, 240, 208/67, 75, 55, 50, 48 AA, 106, 131

[56] References Cited

U.S. PATENT DOCUMENTS

| | | | |
|---|---|---|---|
| 1,876,270 | 9/1932 | Zorn | 44/68 |
| 2,796,387 | 6/1957 | Schmidt | 208/88 |
| 2,825,678 | 3/1958 | Jahnig et al. | 208/88 |
| 3,105,810 | 10/1963 | Miller et al. | 208/85 |
| 3,131,142 | 4/1964 | Mills, Jr. | 208/108 |
| 3,136,714 | 6/1964 | Gibson et al. | 208/88 |
| 3,331,769 | 7/1967 | Gatsis | 208/210 |
| 4,226,742 | 10/1980 | Bearden, Jr. et al. | 502/170 |
| 4,229,283 | 10/1980 | Sosnoski | 208/10 |
| 4,378,288 | 3/1983 | Shih et al. | 208/126 |
| 4,443,325 | 4/1984 | Chen et al. | 258/55 |
| 4,581,127 | 4/1986 | Varghese | 208/143 |

*Primary Examiner*—Andrew H. Metz
*Assistant Examiner*—Anthony McFarlane
*Attorney, Agent, or Firm*—Alexander J. McKillop; Michael G. Gilman; Malcolm D. Keen

[57] ABSTRACT

The coking tendencies of heavy hydrocarbon feedstocks are reduced by treatment with a free radical removing catalyst such as a transition metal naphthenate, preferably at temperatures below 350° C. The treated product has improved stability as such and may be treated in subsequent processing operations such as catalytic cracking and thermal cracking, including visbreaking and coking, with improved liquid yield and reduced coke production.

8 Claims, 2 Drawing Figures

PROCESS FOR UPGRADING HEAVY PETROLEUM FEEDSTOCK

CROSS REFERENCE TO RELATED APPLICATIONS

This application is a continuation-in-part of my prior application, Ser. No. 606,498, filed May 3, 1984, now abandoned, the disclosure of which is incorporated in this application.

FIELD OF THE INVENTION

This application relates to a process for upgrading heavy hydrocarbon feedstocks. More particularly this application is directed to a catalytic process in which the free radical concentration and the coking tendencies of such feedstocks are significantly reduced.

BACKGROUND OF THE INVENTION

During various refining operations petroleum feedstocks are often subjected to high temperatures in order to induce the desired reactions to take place. A side effect of the use of these high temperatures is, however, the formation of coke and this is often undesirable not only because it reduces yield but also because it may have other unfavorable effects upon the course of the process. For example, in fluid catalytic cracking (FCC) operations, the accummulation of coke on the cracking catalysts reduces the activity and selectivity of the catalyst and to overcome this, the catalyst must be cyclically regenerated by burning off the coke. Similar effects may occur in other, non-catalytic refining operations such as visbreaking and thermal cracking where the purpose of the process is to maximize the yield of liquid product and minimize the amount of coke produced, even though a certain amount of coke production has generally been regarded as an unavoidable concomitant of these processes. Even in coking processes, where the production of large amounts of coke has been accepted, the principal objective has been to maximize the yield of high value liquid products and to minimize the coke make, especially of the lower value shot coke. There has therefore been a continuing need to reduce the coking tendencies of petroleum feedstocks.

Various apparatus and process configurations have been employed to minimize coke yield, for example, as described in U.S. Pat. No. 4,385,985 and other approaches have attempted to improve the stability of the feedstock, for example, as described in U.S. Pat. No. 3,331,769, where treatment with a metal compound is used to reduce the degree of coking during a hydrotreating step. Other processes for upgrading and improving the stability of petroleum liquids are described in U.S. Pat. Nos. 3,839,187, 4,181,597 and 4,329,221.

Although the use of hydrogen donors may be effective to remove contaminants without causing a significant degree of coking, as described in U.S. Pat. No. 3,839,187, it would be desirable to avoid the use of hydrogen or hydrogen donors and to rely instead, upon a simple non-hydrogenative process.

SUMMARY OF THE INVENTION

It has now been found that the coking tendencies of petroleum feedstocks are related to the free radical concentrations of the feedstocks and these may both be reduced by a simple, non-hydrogenative treatment which is, moreover, carried out at low temperatures.

According to the present invention, the coking tendencies of heavy hydrocarbon feedstocks are reduced by contacting the feedstock with a free radical removing catalyst at a temperature not greater than 350° C. This process is effective to reduce the general coking tendency of the feedstock and so will benefit any subsequent operations in which it will be exposed to high temperatures when coking would otherwise be likely to occur; however, it is particularly useful prior to non-hydrogenative thermal treatments such as thermal cracking in which there is a tendency to produce a carbonaceous sediment or sludge.

The free radical removing catalysts which are employed according to the present invention are transition metal naphthenates and carbonyls, preferably the molybdenum compounds.

THE DRAWINGS

In the accompanying drawings:

FIG. 1 is a graph which shows the effect of temperature to the free radical concentration of hydrocarbon samples, and FIG. 2 is a graph which shows the effect of temperature on free radical concentration of a free radical removing catalyst.

DETAILED DESCRIPTION

Figure 1:
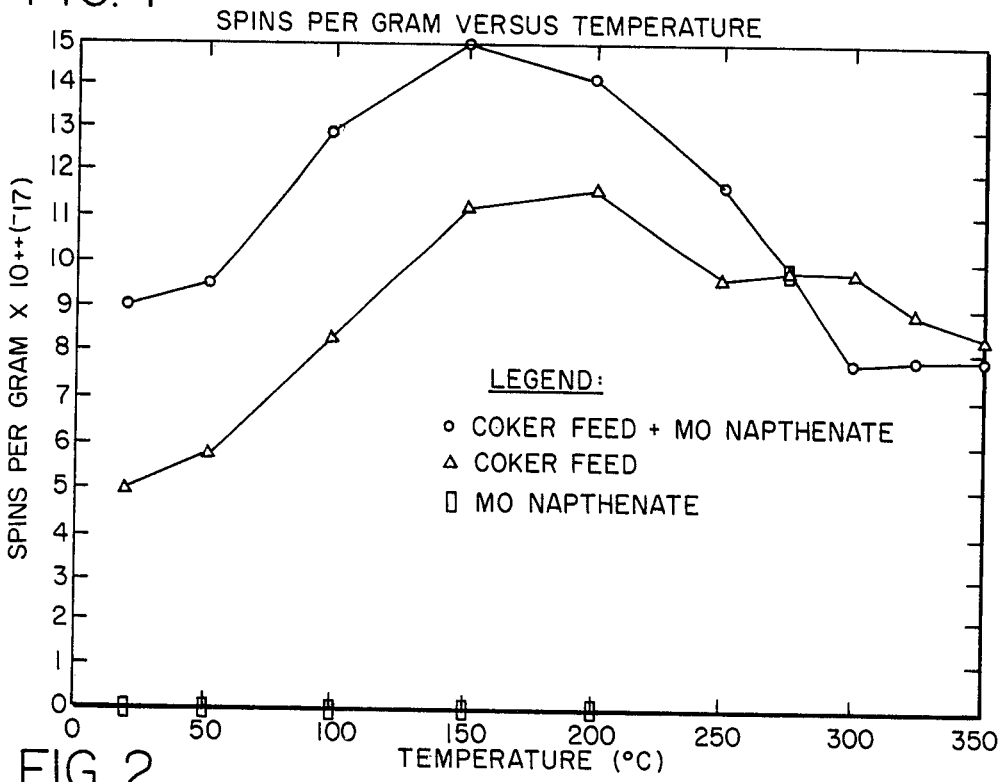

The coking tendencies of petroleum feedstocks such as heavy oils, e.g. heavy gas oils, cycle stocks, residua, reduced crudes and other high boiling fractions (IBP above 350° C. (about 650° F.)), is related to the free radical concentration in the feedstock. According to the present invention, the free radical concentration and hence, the coking tendency, of such feedstocks is reduced by treating the feedstock with a free radical removing catalyst at a temperature not greater than 350° C. The treatment is preferably carried out in the absence of added hydrogen and therefore, no hydrogen will generally be present during the treatment.

The catalysts which are used in the process may be homogeneous or heterogeneous but generally the homogeneous catalysts are preferred since they may be more readily dispersed in the liquid hydrocarbon. Suitable homogeneous catalyst systems include naphthenate salts, especially the naphthenate salts of transition metals, especially nickel and molybdenum, and transition metal carbonyls. Platinum group metal halides may also function effectively.

The naphthenates are a particularly preferred class of catalysts. They are the soap-salts of naphthenic acids which are higher fatty acids, principally monocarboxylic acids, derived from petroleum during refining, normally by extraction from gas oil fractions by extraction with caustic soda solution followed by acidification. The metal soap-salts formed from the acids are notable for their high solubility in hydrocarbons, enabling them to be used as homogeneous catalysts for stabilizing the hydrocarbon feedstocks. Naphthenic acids and the transition metal naphthenates are described in greater detail in *Encyclopedia of Chemical Technology.* Kirk-Othmer, John Wiley & Sons, New York, Third Edition, Vol. 15, pp 749–752, to which reference is made for details of them.

The amount of the catalyst in the feedstock based on the total composition will usually be from 0.01 to 1.0 weight percent, preferably from 0.02 to 0.1 wt. percent.

The temperature for the treatment with the catalyst will normally be from 200° to a maximum of about 350° C., and a temperature equal to or slightly less than about 350° C. is generally preferred.

The treated hydrocarbon is of improved stability, particularly with respect to its coke-forming tendencies and therefore offers significant advantages both as a product in itself and in subsequent processing operations. Because the free radical concentration will, in any event, decrease with time, the advantages of the treatment are most marked with prompt processing at a time when the concentration of free radicals in the feedstock would, but for the catalytic treatment, be high. The processing operations in which the improved stability is most marked are those refining operations, generally of a non-hydrogenative character, which tend to produce a carbonaceous sediment or sludge. Operations of this kind are generally carried out at relatively high temperatures at which the coking tendencies of the feedstocks become manifest, e.g. at temperatures above about 350° C. (about 650° F.) and more commonly above about 400° C. (about 750° F.). Temperatures of this order are encountered in a number of different refining operations to which the heavy feedstocks may be subjected. Generally they will be cracking operations which are either thermal (non-catalytic) or catalytic in nature. Thermal cracking processes which will benefit from the reduced coking tendencies of the treated feedstocks include visbreaking, thermal cracking and various coking processes including delayed coking, contact coking and fluid coking. Although it may appear incongruous that a coking process should benefit from a diminished coking tendency in the feedstock, it should be remembered that the prime purpose of the coking processes is to produce high value liquid products, with gas and coke make minimized as far as possible. The present stabilizing process is therefore an advantageous pre-treatment for a coker feedstock. In fact, not only will the production of liquids be favored by the use of the stabilization step prior to the coking but the coke production itself can be improved, with a relatively higher proportion of sponge coke relative to the lower value shot coke. The reason for this is that shot coke is generally produced when the rate of coking is rapid and the rate of coking is believed to be dependent upon the concentration of free radicals in the feedstock; so, by decreasing the free radical concentration prior to coking, the susceptibility of the feedstock to the production of shot coke will be correspondingly diminished. Because of the decreased coking tendency of the feedstock, it is possible to carry out coking operations, especially delayed coking, at higher temperatures, typically up to 450° C. (about 840° F.), either with or without steam stripping.

Catalytic refining operations which may advantageously follow the stabilization treatment will generally be non-hydrogenative catalytic cracking processes used for producing higher value, lower boiling liquid products from the heavy feedstocks. Of these processes, fluid catalytic cracking (FCC) is the most preferred although other non-hydrogenative catalytic cracking processes such as the various moving bed catalytic cracking processes may also benefit although they are less often encountered in practice. In FCC operations, the amount of coke deposited on the catalyst will be reduced so that the activity and selectivity of the catalyst for producing liquid products will be maintained for a longer average cycle time; a reduced circulation rate with consequently lower attrition rates may therefore be possible and catalyst aging is reduced.

The theory is proposed that the catalyst may function as a hydrogen shuttler, promoting hydrogen migration either on an intramolecular or intermolecular basis, resulting in the capping of the free radicals which are responsible for coke formation. By reducing the free radical concentration, therefore, the feedstock is stabilized particularly in subsequent thermal and high temperature catalytic processing operations. In addition, when the presence of the dispersed metal-containing catalyst can be accepted in the product, a product of improved stability is obtained directly without the need for further processing.

Additionally, greater product stability results in lower losses, greater storage times enhanced pipelining ability and better ability to transport or further upgrade a particular feed.

The invention is illustrated by the following Example:

Experimental Methods

A measure of the free radical concentration in a given sample is provided by the spin (electron spin) concentration which itself may be determined by Electron Spin Resonance Spectroscopy (ESR). In the work reported below, ESR spectra were taken with a Brucker 200D X-band spectrometer system having a 25 cm magnet. A dual cavity was used for all spectra with 100 kHz magnetic field modulation at the sample and reference. The reference sample was a synthetic ruby suitably oriented in the front cavity, which had been calibrated against a freshly prepared sample of $10^{-4}$M DPPH (1,1-diphenyl-2'-picyrlhydrazyl) in toluene. The modulation was always less than the linewidths observed for the vanadium hyperfine splitting (h.f.s.) and was held constant throughout each sequence so as to minimize errors in comparing spectra.

All experiments were performed in precision bore quartz ESR tubes. No attempt was made to exclude atmospheric gases.

Integration of the $Cr^{+3}$ signal in a synthetic ruby was $\pm 1.0\%$ of its average value in 24 independent determinations. Experimental samples were also found to be within $\pm 3.0\%$.

Variable temperature studies were performed using the Brucker variable temperature accessory (VT 4111) employing a wide-bore dewar insert located in the back cavity. This allowed spin concentration measurements by comparison with the $Cr^{+3}$ signal in the ruby during the variable temperature experiments.

Example

The ESR spectra of a coker feed with and without dispersed catalyst (molybdenum naphthenate) were taken at temperatures from 25° to 350° C. Identical aliquots of the coker feed were combined with the molybdenum naphthenate catalyst and warmed in an oven to less than 140° C. to ensure mixing of the feed with the catalyst (0.6% by weight). Both samples were poured warm into the ESR tubes. The spectrum of the catalyst itself was taken at temperatures from 25° to 200° C., the use of higher temperatures being precluded by the volatility of the solvent oil in which the catalyst had been taken up.

The results are given in Table 1 below, reported as spin concentration, N/g (spins/gram).

TABLE 1

| Temperature, °C. | Spin Concentration Coker Feed, $N/g^{-17}$ Base Coker Feed | Coker Feed with Catalyst | Catalyst |
|---|---|---|---|
| 25 | 5.23 | 9.20 | 0.08 |
| 50 | 5.93 | 9.71 | 0.10 |
| 100 | 8.47 | 12.97 | 0.08 |
| 150 | 11.34 | 15.07 | .07 |
| 200 | 11.64 | 14.18 | 0.01 |
| 250 | 9.71 | 11.73 | — |
| 275 | 9.83 | 9.89 | — |
| 300 | 9.75 | 7.82 | — |
| 325 | 8.94 | 7.87 | — |
| 350 | 8.32 | 7.82 | — |

FIG. 1 of the drawings shows the effect of temperature on the free radical concentration of each sample. The sample without catalyst increased in spin concentration with increasing temperature up to 150°-200° C. Above this temperature, the spin concentration decreased gradually to a level approximately 58% higher than its value at room temperature and only 30% lower than the maximum spin concentration.

Coker feed sample with the dispersed catalysts, increased in spin concentration with increasing temperature up to 150°-200° C. at approximately the same rate as the coker sample without catalyst. Above this temperature, the spin concentration decreased rapidly to a level 85% of the room temperature value. This occurred at 300° C. above which there was no change in spin concentration.

These results demonstrate that the dispersed catalyst (molybdenum naphthanate) promotes a rapid decrease in free radical concentration between 150° and 300° C. to a value below that of the original feed. Without the dispersed catalyst the feed has a 60% higher free radical concentration at 350° C. than the original feed at room temperature. The dispersed catalyst sample also showed a variation in spin concentration with temperature.

Figure 2:
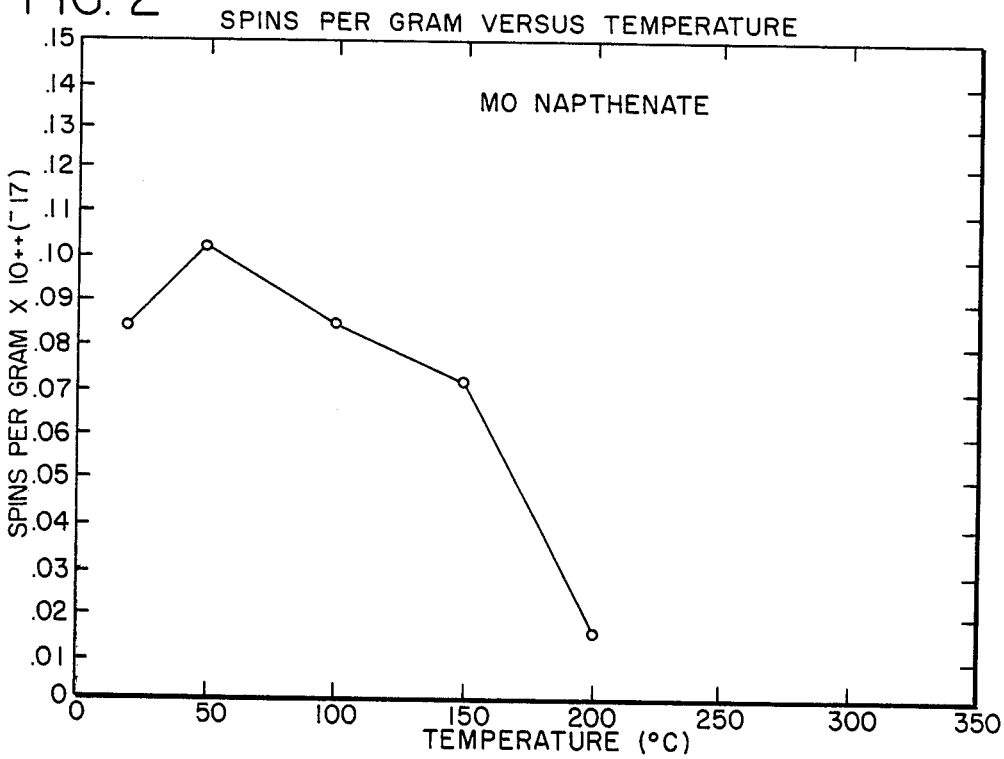

FIG. 2 shows that the spin concentration of the molybdenum naphthenate catalyst increased with increasing temperature and reached a maximum at 50° C. Above this temperature there was a rapid decline in spin concentration which continued to 200° C. The sample was sufficiently volatile that above this temperature measurement was erratic.

The results reported above demonstrate that free radical removing catalysts such as molybdenum naphthenate are effective in modifying the free radical concentration of conventional coker feed at temperatures below 350° C. in the absence of externally added hydrogen. In earlier work it was shown that the coke yield during thermal treatment in the presence of hydrogen and dispersed catalyst was lower than in the absence of catalyst. The radical concentration followed the same trend.

I claim:

1. A method of reducing the coking tendency of a heavy hydrocarbon feedstock in a non-hydrogenative catalytic cracking process which comprises contacting the feedstock prior to catalytic cracking with a free radical removing catalyst comprising a transition metal naphthenate at a temperature below 350° C. for a time sufficient to reduce the free radical concentration of the feedstock whereby the coking tendency of the feedstock to the catalytic cracking process is reduced.

2. A process according to claim 1 in which the free radical removing catalyst comprises molybdenum naphthenate.

3. A process according to claim 2 in which the amount of catalyst is from 0.01 to 1 weight percent of the total weight of the hydrocarbon fluid.

4. A method of reducing the coking tendency of a heavy hydrocarbon feedstock in a non-hydrogenative thermal cracking process which comprises contacting the feedstock prior to thermal cracking with a free radical removing catalyst comprising a transition metal naphthenate at a temperature below 359° C. for a time sufficient to reduce the free radical concentration of the feedstock whereby the coking tendency of the feedstock to the thermal cracking process is reduced.

5. A process according to claim 4 in which the free radical removing catalyst comprises molybdenum naphthenate.

6. A process according to claim 5 in which the amount of catalyst is from 0.01 to 1 weight percent of the total weight of the hydrocarbon fluid.

7. A method according to claim 4 in which the thermal cracking process is a visbreaking process.

8. A method according to claim 4 in which the thermal cracking process is a delayed coking process.

* * * * *